United States Patent [19]

Braun

[11] 4,187,837

[45] Feb. 12, 1980

[54] FINGERNAIL STIMULATING APPARATUS

[76] Inventor: Joseph M. Braun, 1025 E. 13th N., Mountain Home, Id. 83647

[21] Appl. No.: 951,457

[22] Filed: Oct. 16, 1978

[51] Int. Cl.[2] ..... A61H 1/00

[52] U.S. Cl. ..... 128/32; 128/26

[58] Field of Search ..... 128/26, 51, 52, 48, 128/49, 36, 24.2, 41; 132/73.6

[56] References Cited

U.S. PATENT DOCUMENTS

| | | | |
|---|---|---|---|
| 2,079,994 | 5/1937 | Hickernell | 128/49 |
| 2,644,446 | 7/1953 | Viniegra | 128/41 |
| 3,580,246 | 5/1971 | Foreman | 128/26 |
| 3,583,394 | 6/1971 | Napoli et al. | 128/26 |
| 3,587,596 | 6/1971 | Wolff | 132/73.6 |
| 3,654,917 | 4/1972 | Dienner | 128/26 |
| 3,933,151 | 1/1976 | Huie | 128/52 |

*Primary Examiner*—Lawrence W. Trapp
*Attorney, Agent, or Firm*—Paul F. Horton

[57] ABSTRACT

A fingernail stimulating device including a housing adapted for holding in the palm of the hand, one or more vibrators contained within the housing for resiliently engaging the end and top surfaces of fingernails placed through a side opening in the housing, and drive means connected to the vibrators. For operation the drive means may obtain their power either from batteries contained within the housing or from an external power source. The device may also be provided with a thumbnail stimulator similar in construction to the fingernail stimulator.

8 Claims, 4 Drawing Figures

FINGERNAIL STIMULATING APPARATUS

BACKGROUND OF THE INVENTION

1. Field of the Invention

This invention relates in general to body stimulating devices, and in particular to devices for stimulating fingernails.

2. Description of the Prior Art

An individual's hands are second only to the eyes in expressiveness and the ability to communicate to others. The desirability of having strong, healthful, and attractive nails has long been recognized. Nails are composed entirely of closely packed keratin produced by the moon-shaped matrix extending under the nail folds, the visible portion of which is known as the cuticle. Stimulation of the nail increases matrix circulation and augments both the growth and quality of the nail. In addition, stimulation of the nails promotes the feeling of relaxation, well being, and general health of the entire body. In the past, nail stimulation has been provided by buffing, massaging, and filing the nails as well as by everyday chores and by manual manipulation of the nails by pressing or rubbing.

SUMMARY OF THE INVENTION

The present invention comprises fingernail stimulating apparatus including a housing with a side opening; one or more resilient pads within the housing for engaging the fingernails and means for vibrating the pads to stimulate the nails. A more thorough description of the apparatus may be found in the claims.

It is therefore a general object of the present invention to provide apparatus for stimulating one or more nails at a time to promote the growth of strong and healthy nails.

It is a further object of the present invention to provide fingernail stimulating apparatus which is conveniently grasped in the hand and which is electrically energized.

It is a still further object of the present invention to provide fingernail stimulating apparatus having resilient pads for engaging both the end and top surface of the nails.

Additional objects and advantages will become apparent and a more thorough and comprehensive understanding may be had from the following description taken in conjunction with the accompanying drawings forming a part of this specification.

DETAILED DESCRIPTION OF THE INVENTION

Referring now to the FIGS., an embodiment to be preferred of a fingernail stimulating device 10, made according to the present invention is disclosed. Fingernail stimulating device 10 includes a housing 20, vibratory means disposed within the housing and a drive means located within the housing for reciprocating the vibratory means.

Figure 1:
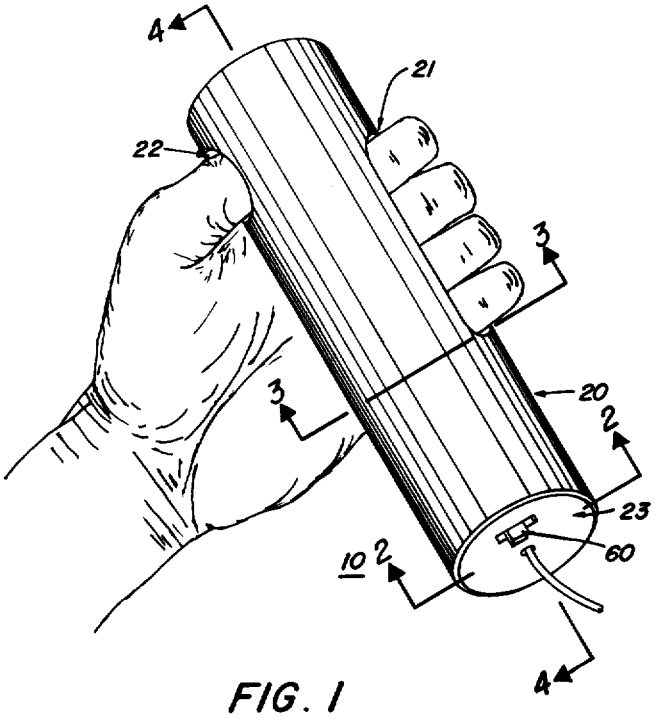
FIG. 1 is a perspective view of the apparatus as held in the hand during use.
Figure 2:
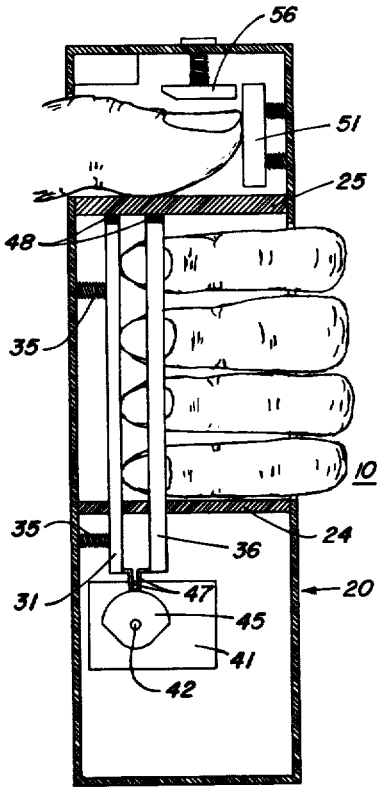
FIG. 2 is a partial sectional view taken along lines 2—2 of FIG. 1 showing vibratory pads.

As may be seen in FIGS. 1 and 2, in particular, housing 20 is adapted to be held in the palm of either hand and has a longitudinal slot 21 in one side thereof for insertion of the fingertips of the four fingers. Housing 20 may include a pair of horizontally spaced, vertical extending finger guide walls 24 and 25. Wall 24 serves as a guide for the little finger and also serves to separate the finger compartment from the motor compartment. Wall 25 serves as a guide for the forefinger and thumb and may serve as a separator between finger compartment and thumb compartment. The housing may optionally have a finger cushion 26 resting on the interior bottom wall of the housing upon which the base of the fingers may be placed, as shown to advantage in FIG. 3. Housing 20 may also be provided with a second slot 22, disposed in an opposing side of the housing from slot 21 for insertion of the thumb. While a cylindrical housing or casing is preferred, as shown in FIG. 1, because it conforms with the shape of a cupped hand, a housing having a rectangular cross section is also suitable. Housing 20 is preferably made of an electrically insulative high impact plastic for safety reasons and may be of any desired color or combination of colors. The external surface of the housing may be further provided with any selected ornamentation. The housing may be provided with a cap 23 for entrance to the housing for repairs or for battery insertion when needed.

Figure 3:
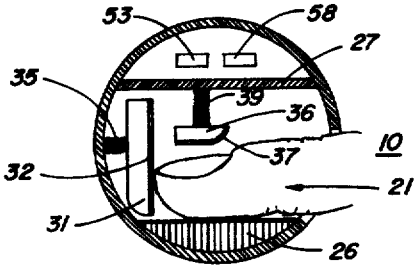
FIG. 3 is a sectional view taken along lines 3—3 of FIG. 1.

Referring now to FIGS. 2 and 3, the working elements of the fingernail stimulator may be seen. The term "fingernail" as used in these specifications and the claims is used in its broadest sense, including thumbnails, unless each type of nail is specified. In the preferred embodiment there is a first vibratory means, for stimulation of the fingernails, and a second vibratory means, for stimulation of the thumbnail. The first vibratory means includes a pair of longitudinal beams 31 and 36 for engaging the fingernails. Beam 31, substantially rectangular in cross-section, is vertically disposed within the housing and is spaced transverse to opening 21 so that the fingers placed through the opening will contact the flat surface of the beam at the free end of the fingernail, as shown to advantage in FIG. 3. Beam 31 is preferably rigid in construction having a flat frontal surface for engaging the nail. It is essential that the frontal surface not be abrasive, thereby preventing any wear or filing of the nail. For this reason, beam 31 includes a resilient lining 32 of soft plastic such as polyethylene, or rubber, or other suitable material. Beam 31 is attached to the back interior side wall of housing 20 by soft rubber pegs 35 permitting lateral movement. Beam 36 is similar in construction to beam 31, but may be provided with a cuvature on the edge adjacent opening 21 for comfortable contact with the cuticle of the finger. Beam 36 is horizontally disposed within housing 20, having its substantially flat fingernail engaging surface parallel with opening 21 and perpendicular with the fingernail engaging surface of beam 31. Like beam 31, it is essential that beam 36 have a non-abrasive surface and therefore a resilient lining 37, identical to lining 32 is provided. Beam 36 is attached to partition walls 27 by a pair of compression springs 39 which permit lateral movement of the beam while applying a gentle downward force on beam 36 and therefore the inserted fingernails. A third longitudinal beam, not shown, with appropriate drive means, identical in configuration and mounting may be parallel-spaced with beams 36 in place of finger cushion 26. Addition of the third beam provides massage to the top of the fingernails when either right or left hand is inserted into side opening 21.

The driving means for vibrating beams 31 and 36 is electric motor 41. Motor 41 is conventional and may be either battery powered or may derive its power from an external source. The preferred motor is a type known as a "shaded pole" motor, having self starting characteristics when operated on alternating current from a conventional power outlet. Motor 41 has an upwardly extending shaft 42 from the armature, to which is attached horizontally oriented cam 45. The cam makes contact with conventional cam followers 47 which are attached, one each to beams 31 and 36 respectively, extending through slots in wall 24. Each of the beams 31 and 36 carry at their ends adjacent wall 25, a compression spring 48 in contact with the wall. It will be seen then, as cam 45 is rotated by motor 41 that followers 47, in secure engagement with beams 31 and 36, cause the beams to reciprocate thereby applying a gentle massage to the fingernails. While a motor with cam constitutes the driving force of the preferred embodiment of the invention, it is obvious that many different types of driving means could be used. For example, beams 31 and 36 may each be connected to an armature of an electric solenoid having a breaking circuit to reciprocate the beams to and fro. It is also obvious that the beams may be reciprocated together, oppositely, or in a number of varying positions.

The second vibrator means for stimulation of the thumbnails includes a pair of thumbnail contacting beams, first beam 51 and second beam 56. First beam 51 is substantially square in shape and has a resilient lining on its flat frontal surface which engages the tip of the thumbnail. Beam 51 is spaced backwardly of and transverse to slot 22. Beam 56 also has a substantially flat resilient surface for contacting the top of the thumbnail and is placed transverse and to the side of slot 22.

Figure 4:
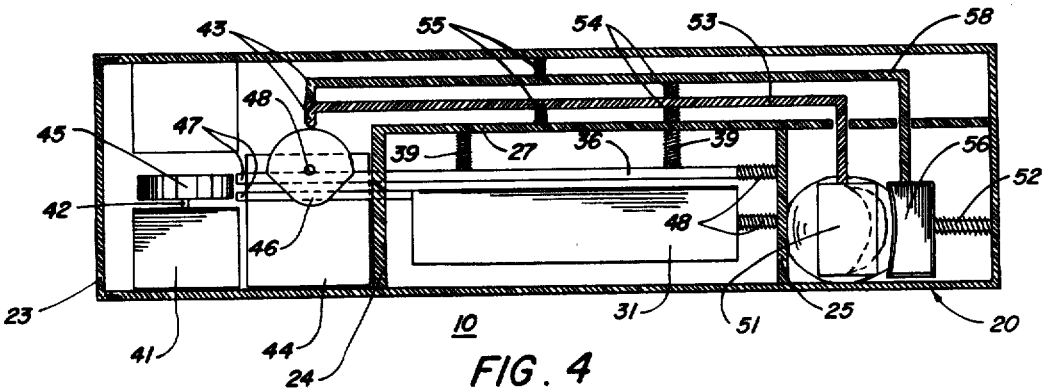
FIG. 4 is a section view taken along lines 4—4 of FIG. 1.

Attached to the uppermost end of beams 51 and 56 are L-shaped arms 53 and 58 respectively, shown to advantage in FIG. 4. The short end of the arms extend through slots in wall 27 of the housing while the longer portion of each arm extends longitudinally in the enclosure at the top of the housing, defined by wall 27, to the motor compartment. Each of arms 53 and 58 serve as levers, having a fulcrum 55 at the substantial mid-portion of the arm. Each of the arms may also be provided with a compression spring 54 tending to hold beams 51 and 56 in an upward position. The terminal end of each arm, extending into the motor compartment, carries a cam-follower 43 for contacting and following cam 48 connected to the armature of motor 44 by shaft 46. As cam 48 is rotated by motor 44 it will be seen that arms 53 and 58 will move up and down in their contact with the compression springs giving a vibratory motion to the beams in contact with the thumbnails. Beam 56 may include a compression spring 52 which both permits an upward and downward movement to the beam while applying a gentle inward force against the top of the thumbnail. As with the first vibratory means, many different types of driving systems might be used to vibrate the beams and it is obvious that one motor might be utilized to vibrate all beams. While in the particular embodiment described, motor 44, like motor 41, derives its power from an external source, it is to be understood that batteries, self contained in the housing, may be used. A single conventional double throw switch 60 with a center-off position may be used for activating a particular motor.

Having thus described in detail a preferred embodiment of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Fingernail stimulating apparatus comprising:

a substantially cylindrical housing adapted to be held in the palm of the hand, said housing having a first side opening operable to receive four fingers from a cupped hand and a second side opening oppositely disposed from the first side opening, the second side opening operable to receive the thumb of the cupped hand;

a first fingernail contacting beam having a flat resilient surface adapted to contact the ends of fingernails placed within the first side opening;

a second fingernail contacting beam having a flat resilient surface adapted to contact the top surfaces of fingernails placed within the first side opening;

a first thumbnail contacting beam having a flat resilient surface adapted to contact the ends of a thumbnail placed within the second side opening;

a second thumbnail contacting beam having a flat resilient surface adapted to contact the top surface of a thumbnail placed within the second side opening; and drive means mounted within said housing drivingly connected to said beams to vibrate said beams whereby the thumbnail and fingernails are stimulated.

2. Fingernail stimulating apparatus comprising: Housing means having a first side opening, a first vibratory means located within said housing means for engaging fingernails placed within said opening, said first vibratory means including a longitudinal beam having a flat resilient surface parallel to said opening for engaging the top of fingernails placed within said openings and resilient connector support means connecting said longitudinal beam to the interior of said housing means, said connector support means operable to place a downward pressure on the fingernails from said longitudinal beams; and drive means mounted within said housing means drivingly connected to said first vibratory means.

3. The apparatus of claim 1 wherein said housing means defines a container adapted to be held in the palm of the hand, said container having a longitudinal slot operable to receive four finges in the side thereof.

4. The apparatus of claim 3 wherein said housing means defines a cylindrical tube having closures at each end.

5. The apparatus of claim 1 wherein said housing means further includes a second side opening oppositely disposed from the first side opening and operable to receive a thumb therein, and a second vibratory means within said housing means for engaging a thumbnail placed within said second opening, said second vibratory means drivingly connected to a second drive means.

6. The apparatus of claim 5 wherein said second vibratory means include a first longitudinal thumbnail contacting beam having a resilient surface, said first thumbnail beam transversely spaced from the second side opening for engaging the end of a thumbnail placed within the second opening and a second longitudinal thumbnail contacting beam having a resilient surface parallel to the second side opening for engaging the top surface of a thumbnail placed with the second side opening.

7. The apparatus of claim 1 wherein said drive means includes a battery driven motor.

8. The apparatus of claim 1 wherein said drive means includes a motor obtaining its power from an external power source.

* * * * *